United States Patent [19]

Yamazaki et al.

[11] Patent Number: 4,552,451

[45] Date of Patent: Nov. 12, 1985

[54] CLEANING DEVICE

[75] Inventors: Yoshio Yamazaki, Mizuho; Takashi Itoh, Tokyo, both of Japan

[73] Assignee: Konishiroku Photo Industry Co., Ltd., Tokyo, Japan

[21] Appl. No.: 504,035

[22] Filed: Jun. 13, 1983

[30] Foreign Application Priority Data

| | | | |
|---|---|---|---|
| Jun. 21, 1982 | [JP] | Japan | 57-105434 |
| Jun. 21, 1982 | [JP] | Japan | 57-105435 |
| Jun. 21, 1982 | [JP] | Japan | 57-105436 |
| Jun. 22, 1982 | [JP] | Japan | 57-106183 |

[51] Int. Cl.[4] ..... G03G 15/08

[52] U.S. Cl. ..... 355/15; 355/3 DD; 355/14 D

[58] Field of Search ..... 355/15, 3 DD, 14 D; 118/652; 430/125

[56] References Cited

U.S. PATENT DOCUMENTS

| | | | |
|---|---|---|---|
| 4,108,546 | 8/1978 | Rezanka | 355/15 |
| 4,252,435 | 2/1981 | Manghirmalani | 355/15 |
| 4,395,114 | 7/1983 | Ura et al. | 355/15 |
| 4,416,537 | 11/1983 | Gundlach | 355/15 |
| 4,428,665 | 1/1984 | Hays | 355/15 |

*Primary Examiner*—A. C. Prescott

*Attorney, Agent, or Firm*—James E. Nilles

[57] ABSTRACT

A cleaning device for separating residual magnetic toner on an image carrier from the image carrier and for magnetically absorbing the separated magnetic toner by a rotary magnet member and transferring on a guide member on the surface of which a shifting field is induced by the rotary magnet member and which covers the surface of the magnet member from the part approaching the image carrier to the part on the opposite side where the magnetic toner drops down by its own gravity and removing it away. A vibration imparting device is provided for vibrating the guide member.

4 Claims, 13 Drawing Figures

CLEANING DEVICE

BACKGROUND OF THE INVENTION

1. Field of the Invention:

This invention relates to an improvement in an image carrier cleaning device for an electrophotographic copying machine, and more particularly, to an improvement in a cleaning device including cleaning means for separating residual magnetic toner or magnetic developer, both hereinafter referred to as toner or magnetic toner, on an image carrier from the image carrier and transfer means for magnetically absorbing the separated magnetic toner and transferring and removing it away.

2. Description of the Prior Art:

As a cleaning device of the kind referred to in the above, several types of cleaning devices have conventionally been suggested.

One of the conventional cleaning devices is the one wherein the transfer means absorbs directly the magnetic toner on the surface of its rotary magnet roller and transfers and removes the toner away by the rotation of the magnetic roller; or the transfer means absorbs the magnetic toner on the surface of a rotary or stationary sleeve covering the rotary magnet roller or rotary magnet member of the transfer means and transfers and removes the toner away by the rotation of roller or magnet.

This type of conventional cleaning device is, however, defective in some respects. This cleaning device employs the direct absorbing system of magnetic toner on the rotary magnet roller or sleeve of the transfer means, and therefore, it requires a toner scraping means additionally for removing the toner attached directly to the transfer means. Further, the absorbed toner is likely to accumulate around the part where the toner scraping means is provided, and a filming of toner is apt to occur on the rotary magnet roller or sleeve, both resulting in a degradation of performance of transferring and removing the magnetic toner.

The scraping operation of the toner scraping means causes a rapid wearing of the surface of the rotary magnet roller or sleeve and the toner scraping means itself. In addition, it is also one of the greatest problems to be overcome that the toner scraping means unfavorably gives resistance to the drive of the rotary magnet roller and the like.

Another conventional cleaning device is the one wherein the transfer means is very simple in structure without a provision of any kind of toner scraping means, but employs the magnetic force for removing the toner away. In more detail, the transfer means is constituted by a rotary magnet member and a guide member of the surface of which a shifting field is induced by the rotary magnet member and which covers the surface of the rotary magnet member at least from the part where the rotary magnet member approaches the image carrier to the part on the opposite side where the magnetic toner drops off by its own gravity. This cleaning device also includes a cleaning means for separating the toner from the image carrier. In operation, the magnetic toner remaining on the image carrier is separated by the cleaning means, caught by the shifting field on the surface of the guide member and transferred to the opposite side, where it comes out of the influence of the magnetic force of the rotary magnet member and drops down by its own gravity.

This second conventional cleaning device is advantageous over the first one in that no additional toner scraping means is needed for scraping toner. However, the second device has also several defects which are expected to remove. One of the defects is that the transferred toner is apt to stay on the surface of the guide member at the part where the influence of the magnetic force of the rotary magnet member is relatively weak. Another defect is that the dropping toner accumulates at one position, not utilizing effectively a reservoir for retaining the collected toner.

SUMMARY OF THE INVENTION

A primary object of the present invention is to remove the abovementioned defects inherent in the conventional cleaning devices in which the transfer means absorbs the magnetic toner by the magnetic force and transfers and removes it away.

According to the cleaning device of the present invention, the transfer means is characteristically constituted by a rotary magnet member and a guide member on the surface of which a shifting field is induced by the magnet member and which covers the surface of the magnet member at least from the part approaching the image carrier to the part on the opposite side where the magnetic toner drops off by its own gravity, and therefore, the magnetic toner can be removed from the transfer means without using any kind of toner scraping means.

Another object of the present invention is to provide a cleaning device which includes a cleaning means for separating magnetic toner remaining on the image carrier from the image carrier and a transfer means for magnetically absorbing the separated magnetic toner and transferring and removing it away. The cleaning device is characterized in that the transfer means is constituted by a rotary magnet roller which approaches the image carrier and a guide member on the surface of which a shifting field is induced by the magnet roller and which extends along the surface of the magnet roller at least from the part where the roller approaches the image carrier (at this part, the end of the guide member is in contact with the roller surface) to the part on the opposite side where the magnetic toner drops off by its own gravity.

This characteristic structure is very advantageous over the conventional cleaning devices as described in the foregoing. The need of provision of a toner scraping means and the like in the transfer means can be eliminated, and accordingly, the toner stay and accumulation and toner filming due to the operation of the scraping means are not found. As a consequence, the guiding surface of the transfer means is protected from wearing and the absorption and transfer of magnetic toner becomes very stable.

Additionally, the rotary magnet roller can be approached as close to the image carrier surface as in the cleaning device of the type that the rotary magnet roller absorbs directly the magnetic toner. Thus, the toner absorbing and transferring capability can be much improved.

Further, in the cleaning device of the present invention, the requirements as to the parts accuracy and assembly accuracy are not so severe, and the assembling thereof is relatively easy.

A third object of the present invention is to provide a cleaning device wherein a vibration imparting means is provided for easily removing the magnetic toner from the guide member by giving vibration thereto.

The other objects and advantages of the present invention are apparent on reading the detailed description of the construction and operation in conjunction with the accompanying drawings.

DESCRIPTION OF THE PREFERRED EMBODIMENTS

Figure 1:
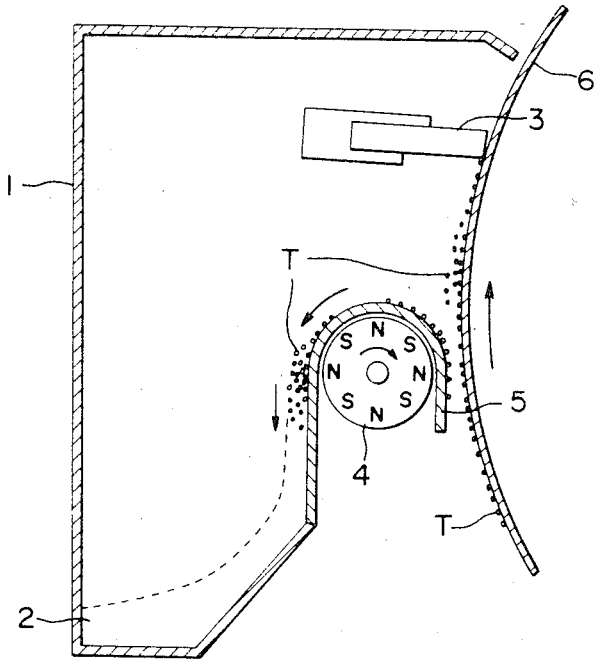
FIG. 1 is a sectional view of the cleaning device according to an embodiment of the present invention.

Referring to FIG. 1 in which the cleaning device according to a first embodiment of the present invention is shown in the cross section, numeral 1 denotes a casing of the cleaning device, the bottom part of which is formed in a toner reservoir 2. Numeral 3 denotes a scraper blade formed integrally with the casing 1 and numeral 4 denotes a magnet member consisting of a magnet roller which is rotatable in a direction indicated by an arrow in the drawing. Numeral 5 designates a guide member made of the same material as that of the sleeve of the conventional cleaning device, so that a shifting field is induced on the surface by the magnetic force of the magnet member 4. The guide member 5 is designed to have such a length as extends substantially in a U-shape from the part of the magnet member 4 which approaches an image carrier 6 to absorb magnetic toner T remaining on the carrier surface to the part where the influence of the shifting field induced by the magnet member 4 is so weak that the absorbed magnetic toner T drops off by its own gravity. In the illustrated embodiment, the guide member 5 is connected to one end of the casing 1.

In operation, the remaining toner T on the surface of the image carrier rotating in the arrow direction is scraped by the scraper blade 3 and caught on the surface of the guide member 5 where a shifting field is induced by the magnet member 4. Then, under the influence of the shifting field, the toner T moves along the surface of the guide member 5 in a direction by other two arrows. When released from the magnetic absorption at the part away enough to come out of the influence of the shifting field, the toner T drops down into the toner reservoir 2 and is accumulated therein.

Thus, with this construction, the remaining toner T on the image carrier 6 can be removed away without using any toner scraping means to the guide member 5. This means that the cleaning device of the present invention having the above construction is very advantageous over the conventional device of the type that the transfer means employs the magnetic force for absorbing the magnetic toner T. Namely, the cleaning device of the present invention does not include any kind of toner scarping means for the rotary magnet roller or sleeve where the toner T is absorbed, which is unavoidably worn in a long service, and additionally, the provision of which works as a resistance source to the driving part of the cleaning device. Accordingly, this construction is very effective not only for saving power for driving the device but also for simplifying the entire structure and facilitating the maintenance of the device.

As apparent from the description of the structure, the guide member never comes into contact with the surface of the image carrier, and therefore, the image carrier can be positively protected from being given damage.

The problem of filming occurrence is also overcome.

To ensure a stable and secure removal and transfer of toner remaining on the image carrier is one of the greatest effects obtained by the cleaning device of the present invention.

Regarding the rotary magnet member, although it is preferable to use a rotary magnet roller, in view of the simplification of the structure, of the same kind as used in the conventional magnetic brush developing device and cleaning device, any other suitable member can be used, for example, a stationary magnet inducing a rotary magnetic field. Without saying, such a design of the guide member is also possible as it is arranged quite apart from the casing, as will be referred to later with reference to FIG. 6.

Figure 2:
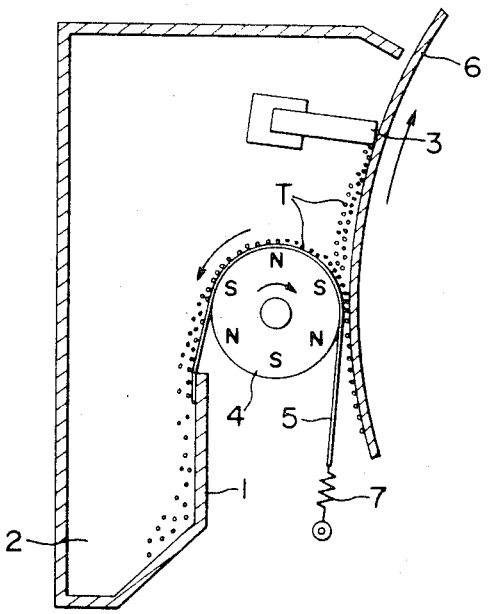
FIG. 2 is a similar sectional view to FIG. 1 of the cleaning device according to another embodiment of the present invention.

Referring to FIG. 2 in which a second embodiment of the present invention is shown in the cross section, one end of the guide member 5 is coupled with the tip end of the casing 1 which is arranged at a separate position from the magnet roller 4. The middle part of the guide member 5 is hung over the magnet roller 4, with the other end connected to a spring 7 so as to retain the guide member 5 substantially in a stretched condition.

Figure 3:
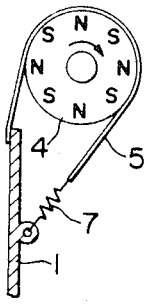
FIGS. 3 through 6 are fragmentary cross sections respectively showing the transfer means of different types.

In the structure of the guide member 5 shown in FIG. 3, the spring 7 is secured to the casing 1 at the other end thereof.

Figure 4:
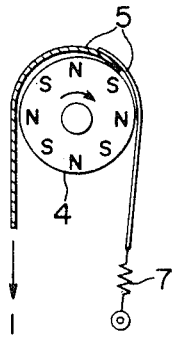
Figure 5:
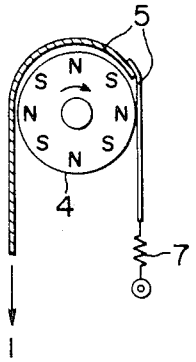

FIGS. 4 and 5 show a further modification of the guide member 5, in which the tip end part of the casing is extended to cover a part of the upper surface of the magnet roller 4 so as to constitute a part of the guide member 5. FIG. 5 shows the characteristics of the guide member 5 operation that when the guide member 5 is not attached with the magnetic toner T, it remains at a position spaced from the roller 4 with a small gap, whereas attached with the toner T, it is brought into contact with the roller 4 under the influence of the attracting force induced between the roller 4 and toner T.

Figure 6:
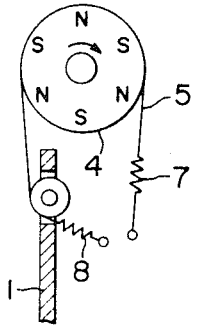

In a still further modification illustrated in FIG. 6, the guide member 5 is supported by another spring 8 without being connected to the casing 1.

Next, regarding the material of which the guide member 5 is made, it is generally preferable to use a non-magnetic flexible material such as a resinous film or polyethylene terephthalate (PET) film, polyimide film and the like, or phosphoric bronze thin plate and the like of a thickness of 0.05–0.2 mm. In this case, the part of the guide member 5 constituted by the extended part of the casing 1 as in the FIGS. 4 and 5 examples does not receive this restriction of material.

In more detail, if the tip end of the casing 1 has little flexibility, a resinous film which is elastic and extensible is most suitable for the guide member 5. To the contrary, if the tip end of the casing 1 has a sufficient flexibility, the material of the guide member 5 is not limited to the resinous film.

In the example of the FIGS. 4 and 5, the extended part of the casing 1 is preferably made of a non-magnetic metallic material such as aluminum or phosphoric bronze thin plate, and in this case, the guide member 5 connected to the extended part is not always restricted to be made of a resinous film.

In the FIG. 6, as the guide member 5 has such a construction as it is quite separated from the casing 1 and connected to the springs 7 and 8 at the two ends, the material thereof need not be restricted to the one having sufficient elasticity and extensity, even if the casing 1 has a small flexibility. If a modification is effected in this stucture to omit the spring 8 and use an elastic and extensible material for the guide member 5, the structure becomes the same as the examples shown in the FIGS. 2 and 3.

With the cleaning device constructed in the above-mentioned structure and made of the above-mentioned material of the present invention, the magnetic toner T scraped by the scraper blade 3 above the transfer means and absorbed on the surface of the guide member 5 of the transfer means is made to drop down naturally without interruption by the vibrations due to the stick slips which are caused when the guide member 5 is brought into contact with the magnet roller 4. Then, the toner T dropping from the guide member 5 into the toner reservoir 2 at the bottom of the casing 1, if the casing 1 is connected to the guide member 5 and transmitted the vibrations, is scattered over the bottom of the reservoir 2 universally without accumulating at one particular place.

The vibrations due to the stick slips of the guide member 5 in the rotary direction of the magnet roller 4 indicated by an arrow in the drawings impart the moving effect to the toner T on the guide member 5 in the same direction as the rotation of the magnet roller 4. However, as the shifting field effect to the magnetic toner T is stronger than the moving effect, the toner T is not prevented from moving in the arrow direction shown in the middle of FIG. 2.

It should be noted here, that the rotary magnet roller 4 may be replaced by any other member, such as a magnet rubber roller or magnet-arranged member, as far as it permits magnetic poles to appear on the surface. The number of the magnetic poles can be determined appropriately in the relation with the rotation speed of the magnet member.

The magnetic toner T attached on the surface of the guide member 5 moves in the direction reversed to the rotary direction of the rotary magnet member 4 under the influence of the shifting field. When it comes to the opposite side to the image carrier 6, the toner T does not receive any longer the influence of the magnetic field and drops down into the toner reservoir 2. In this instance, if the reservoir wall 1' is stationary, the magnetic toner T is likely to stay at the part out of the magnetic field as shown by a two-dotted chain line in FIG. 7 and accumulate along the reservoir wall 1' on the toner dropping side.

In view of this inconvenience, in the cleaning device according to the further embodiment of the present invention, a vibration imparting means 9 is additionally provided, which is adapted to vibrate under the magnetic force of the magnet member 4 and transmit its vibration to the guide member 5.

Figure 7:
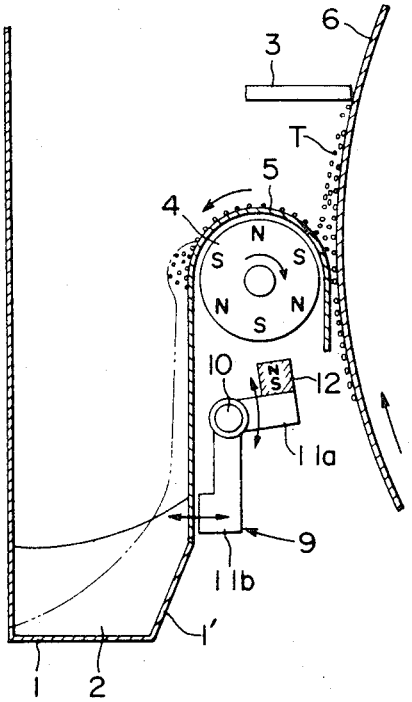
FIG. 7 is a similar sectional view to FIGS. 1 and 2 of the cleaning device according to a third embodiment of the present invention.

The vibration imparting means 9 in FIG. 7 comprises a swinging lever engaged swingably with a shaft 10 and a magnet 12 mounted on the swinging lever. The swinging lever comprises a motion arm 11*a* and an operation arm 11*b* and the magnet 12 is located on the motion arm 11*a* to oppose the rotary magnet member 4. When the rotary magnet member 4 rotates, the magnet 12 is attracted and repulsed by the magnet member 4, so that the entire of the swinging lever makes a reciprocative motion. In this reciprocative motion of the lever, the operation arm 11*b* strikes the reservoir wall 1' of the toner reservoir 2. Accordingly, the toner T in the reservoir 2 receives vibrations to scatter substantially uniformly over the bottom of the reservoir 2.

Figure 8:
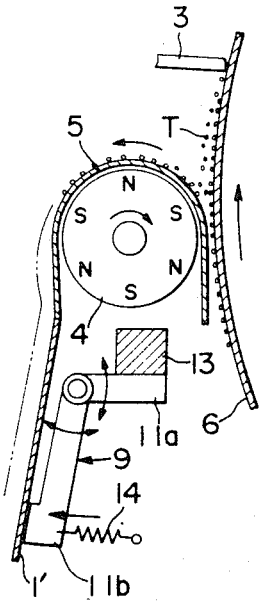
FIGS. 8 through 11 are fragmentary cross sections respectively showing different modifications of the cleaning device shown in FIG. 7.

The vibration imparting means 9 in the FIG. 8 is different from that of FIG. 7 in that the magnet 12 is replaced by a magnetic member 13 and the swinging lever is provided with a spring 14 for biasing the lever in the return direction.

Figure 9:
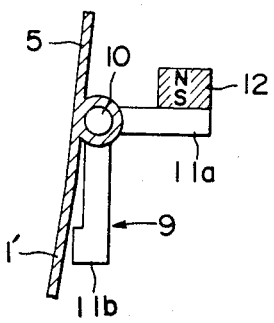

The vibration imparting means 9 in FIG. 9 is a slightly modified example of the means shown in FIG. 7. That is, the shaft 10 of the swinging lever is secured to the guide member 5 of the reservoir wall 1' fixedly.

Figure 10:
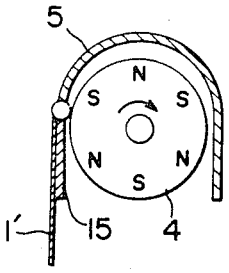

The structure of the vibration imparting means 9 in FIG. 10 is quite different from the other ones. A joint-like flexible structure is provided at the part of the guide member 5 where the guide member 5 separates from the rotary magnet member 4, and on the other hand, a magnet member 15 is arranged on the reservoir wall 1' at such a position as receives the influence of the magnetic force of the rotary magnet member 4.

Figure 11:
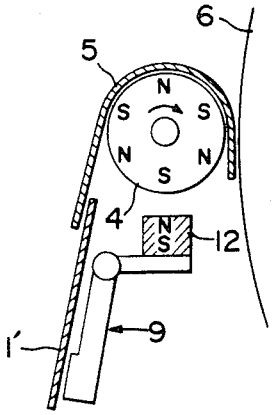

In FIG. 11, the guide member 5 is disconnected from the reservoir wall 1', and the vibration imparting means 9 of the same kind as in FIG. 7 is provided for striking the reservoir wall 1', so that the vibration imparted to the toner reservoir 2 is transmitted to the guide member 5.

In the aforementioned examples, both of the guide member 5 and toner reservoir 2 are imparted with vibrations by the vibration imparting means 9, and accordingly, the magnetic toner T attached and transferred on the guide member 5 never stays at the part out of the influence of the magnetic field, and neither polarizes at a certain position in the toner reservoir 2.

The present invention is not restricted to the examples illustrated in the accompanying drawings and described in the foregoing, but may be modified further within the spirit of the present invention. For example, such a structure is also possible as imparts vibrations only to the guide member 5. The rotary magnet member can be replaced by other members which induce a rotary magnetic field of the same kind as that induced by the rotation of an electromagnet.

Figure 12:
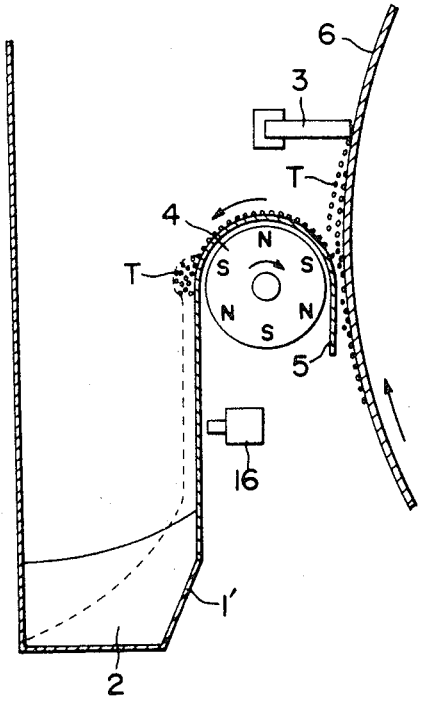
FIG. 12 and FIG. 13 are sectional views showing a further embodiment of the present invention.
Figure 13:
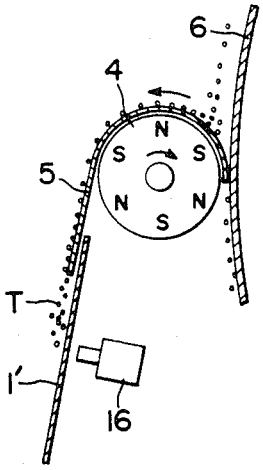

FIGS. 12 and 13 show the structure of the cleaning device according to a still further embodiment, in which an electromagnetic vibrator 16 is employed as the vibration imparting means.

What is claimed is:

1. A cleaning device including a cleaning means for residual magnetic developer on a movable image carrier from said image carrier and a transfer means for magnetically absorbing said magnetic toner developer and transferring and removing it away, characterized in that said transfer means comprises a rotary magnet member and a guide member on the surface of which a shifting field is induced by said rotary magnet member and which covers the surface of said magnet member at least from the part approaching said image carrier to the part on the opposite side where said magnetic developer drops down by its own gravity, said magnet member being rotated in a direction opposite to the moving direction of said image carrier at a position facing said image carrier, and said guide member extending from a position approaching said image carrier to a position on the opposite side with respect to said magnet member along an upper portion of the outer peripheral surface of said magnet member.

2. A cleaning device as claimed in claim 1, wherein said rotary magnet member approaches said image carrier, and said guide member is flexible and in contact with the surface of said rotary magnet member.

3. A cleaning device as claimed in claim 2, wherein said transfer means further comprises a vibration imparting means which vibrates under the magnetic force of said rotary magnet member and transmits the vibration to said guide member.

4. A cleaning device as claimed in claim 2, wherein said transfer means further comprises a vibration imparting means which vibrates independent from the magnetic force of said rotary magnet member and transmits the vibration to said guide member.

* * * * *